US006000656A

United States Patent [19]

Taylor et al.

[11] Patent Number: 6,000,656

[45] Date of Patent: Dec. 14, 1999

[54] SPACE SAVING WIRE DRAWING MACHINE WITH FLOOR MOUNTED WIRE COIL

[75] Inventors: Timothy J. Taylor, Roscoe, Ill.; Dale J. Pitzen, Beloit, Wis.

[73] Assignee: Rockford Manufacturing Group, Inc., S. Beloit, Ill.

[21] Appl. No.: 09/061,638

[22] Filed: Apr. 16, 1998

[51] Int. Cl.[6] ..... B65H 23/18; B21C 1/02

[52] U.S. Cl. ..... 242/418.1; 72/289; 242/365.7; 242/564.3

[58] Field of Search ..... 242/559.4, 563.1, 242/564.3, 418.1, 365.7, 615.3; 226/43, 44; 72/5, 288, 289

[56] References Cited

U.S. PATENT DOCUMENTS

| | | | |
|---|---|---|---|
| 1,562,997 | 11/1925 | Van Orman | 242/418.1 |
| 2,575,785 | 11/1951 | Beaman et al. | 242/559.4 X |
| 3,339,396 | 9/1967 | Carlson | 72/289 |
| 3,646,798 | 3/1972 | Alcock | 72/289 |
| 4,099,403 | 7/1978 | Alcock et al. | 72/288 |
| 4,947,665 | 8/1990 | Alcock et al. | 72/289 X |
| 5,097,688 | 3/1992 | Taylor et al. | 72/5 |
| 5,497,928 | 3/1996 | Burns et al. | 226/108 |
| 5,673,584 | 10/1997 | Kuroda et al. | 72/235 |

OTHER PUBLICATIONS

Circle Reader Service Card No. 69, Fastener Engineers—Lewis Machine Advertisement introducing "Integrated Pay-off" In–Line Wire Drawers.

*Primary Examiner*—Michael R. Mansen
*Attorney, Agent, or Firm*—Leydig, Voit & Mayer

[57] ABSTRACT

An in-line wire drawing machine with a floor mounted wire coil turntable and laterally disposed power-driven capstan. The present invention provides an in-line wire drawing machine which substantially reduces the footprint required for an in-line wire drawing machine while enabling relatively large diameters wire to be drawn therethrough. The wire coil is mounted at floor level to allow the coils to be easily loaded onto the drawing machine. The turntable and capstan are mounted in side-by-side fashion to allow the wire to be paid off from the coil in an arc following the natural arcuate cast of the wire coil. This avoids the problem of requiring the operator to physically force the wire against its natural cast and through the guide rollers of the drawing machine which is extremely difficult when using large diameter wire.

20 Claims, 7 Drawing Sheets

SPACE SAVING WIRE DRAWING MACHINE WITH FLOOR MOUNTED WIRE COIL

FIELD OF THE INVENTION

The present invention generally relates to wire drawing machines, and more particularly relates to wire drawing machines which decrease the footprint required by the machine on the shop floor.

BACKGROUND OF THE INVENTION

Large diameter wire or cable is typically fabricated in spiral-wound coils weighing thousands of pounds. In order to reduce the wire coil into usable lengths, the wire coil is typically fed through a wire drawing machine which can reduce the diameter of the wire and feed the wire to a machine to cut the wire into suitable lengths.

A variety of machines therefore have been developed for drawing the wire from the coil and to a reducing machine, cutting machine, or the like. For example, U.S. Pat. No. 5,497,928, assigned to the present assignee, discloses a machine wherein a spool of wire is unwound to a wire straightening apparatus and then to a wire cutting apparatus. Each of the three aforementioned elements is disposed in linear fashion which therefore occupies a relatively large expanse of shop floor space in that the overall footprint of the machine is relatively long, although also relatively narrow.

Machines have therefore been developed which allow the wire to be pulled from the coil but which do so while occupying relatively little floor space in that the various elements are not placed on the shop floor in linear orientation. For example, U.S. Pat. No. 5,097,688, also assigned to the present assignee, discloses an in-line wire drawing machine wherein the wire coil is mounted on a turntable which itself is mounted directly on the main base of the wire drawing machine. A power-driven capstan is provided on the main base and below the turntable such that the rotation of the capstan will pull the wire from the coil. The wire is pulled downwardly from the coil which is mounted on top of the support and through a series of rollers around a fairly complex path, against the natural cast of the wire, in route to reaching the drawing machine. However, since the wire coil is mounted directly on top of the main base of the machine, the overall footprint of the machine is relatively small.

Still further machines have been developed which allow the wire coil to be mounted directly on the shop floor or on top of a base which itself is mounted directly on the shop floor to thereby avoid the aforementioned problem of mounting the large diameter wire coil on top of the capstan base. However, no satisfactory means has been developed to allow such large diameter wire to be guided from the wire coil and to the side mounted in-line wire drawing machine. Such large diameter wire cables can be in excess of one-half inch in diameter which necessarily makes the process of bending and contorting the wire to pass through the guides of the machine relatively difficult. If the path which the wire coil must traverse is complex and requires multiple bends in multiple directions, such machines can be difficult to operate, dangerous, and prohibitively expensive. It would therefore be advantageous to provide a wire drawing machine which minimizes space requirements, while allowing the wire to be drawn along its natural cast to maximize ease of operation.

SUMMARY OF THE INVENTION

It is therefore a primary aim of the present invention to provide a wire drawing machine which allows the wire coil to be mounted at floor level. The floor level mounting system facilitates loading of coils of wire on to the turntable.

It is an objective of the present invention to provide a wire drawing machine which occupies a relatively small footprint of a shop floor in that the wire coil and drawing machine are mounted laterally as opposed to disposition in linear fashion across the shop floor.

It is still another objective of the present invention to provide a wire drawing machine which is easy to thread and guide the wire through in that the pay out of the machine follows the natural arcuate cast of the wire coil.

In accordance with these aims and objectives, it is a feature of the present invention to provide an in-line wire drawing machine wherein the wire coil is mounted on a turntable to the side of the power-driven capstan which unwinds the coil. This therefore avoids the aforementioned footprint problem of linearly disposed machines.

It is another feature of the present invention to provide the aforementioned side mounted in-line wire drawing machine wherein the wire is fed from the wire coil in an arcuate path directly to the side mounted capstan to thereby allow the wire to follow the natural arcuate cast of the wire coil and avoid the need for a human operator to physically wrench and contort the wire coil.

It is a feature of a preferred embodiment of the present invention to provide an in-line wire drawing machine for unwinding wire from a coil of wire and feeding the wire to a downstream end-use machine wherein the coil of wire is cast in a spiral pattern and thus has an arcuate natural cast. The in-line wire drawing machine comprises a base provided at shop floor level, a vertical support extending upwardly from the base, a turntable mounted to the base, and a power-driven capstan mounted on a second side of the support. The vertical support extends substantially above the shop floor level and includes a front, a back, and first and second opposed sides. The turntable is disposed adjacent and below the first side of the support with the wire coil being mounted on the turntable. The wire extends from the coil, around the back of the support and is trained around the capstan such that rotation of the capstan pulls the wire from the coil along an arc following the natural arcuate cast of the wire coil.

It is another feature of the present invention to provide the aforementioned in-line wire drawing machine which further includes a means for detecting a snag in the wire coil and automatically stopping rotation of the capstan when the snag is detected to avoid damage to the capstan, wire, motor, and operator.

These and other aims, objectives, and features of the present invention will become more apparent from the following detailed description when taken in conjunction with the accompanying drawings.

Figure 1:
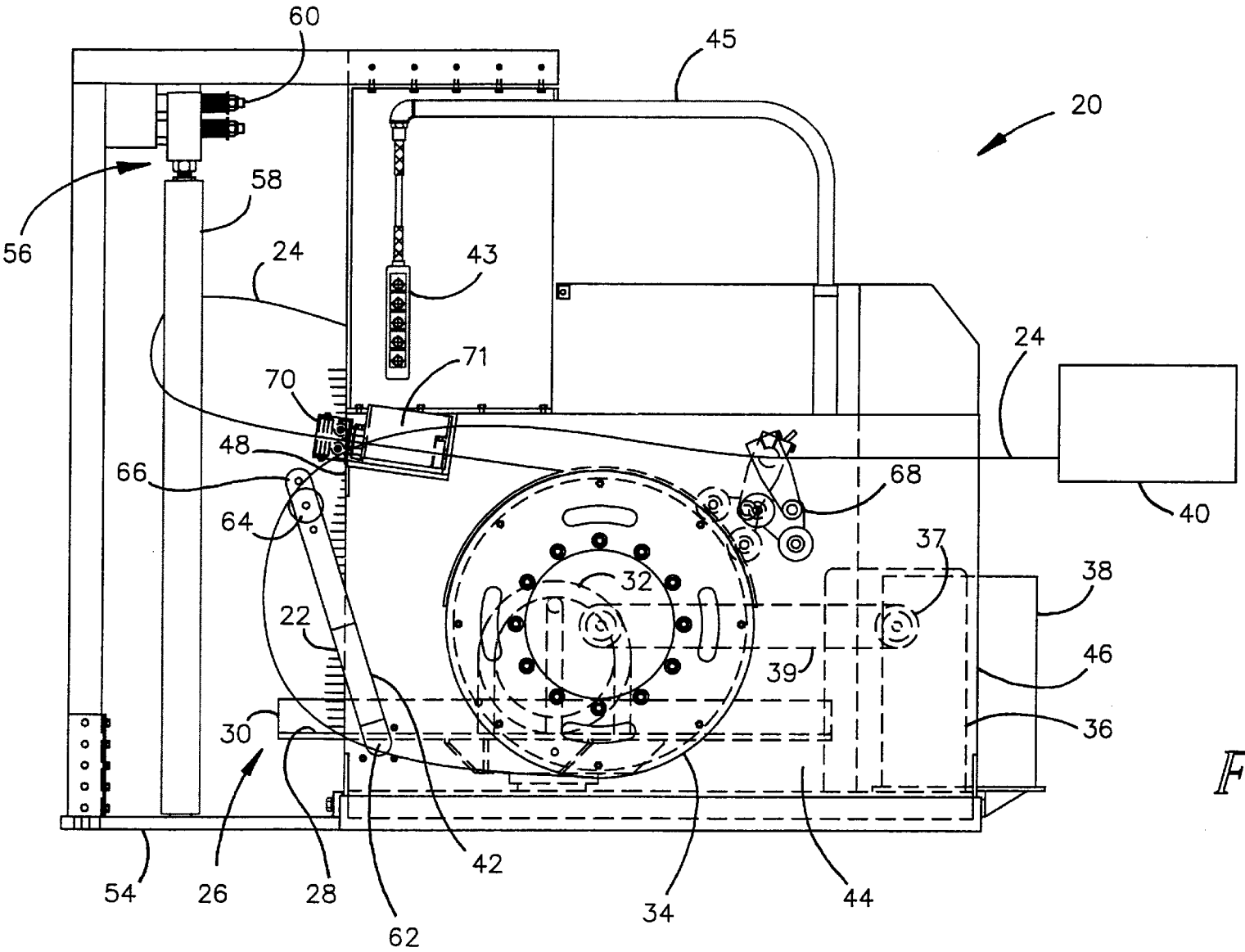
FIG. 1 is a side view of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Figure 2:
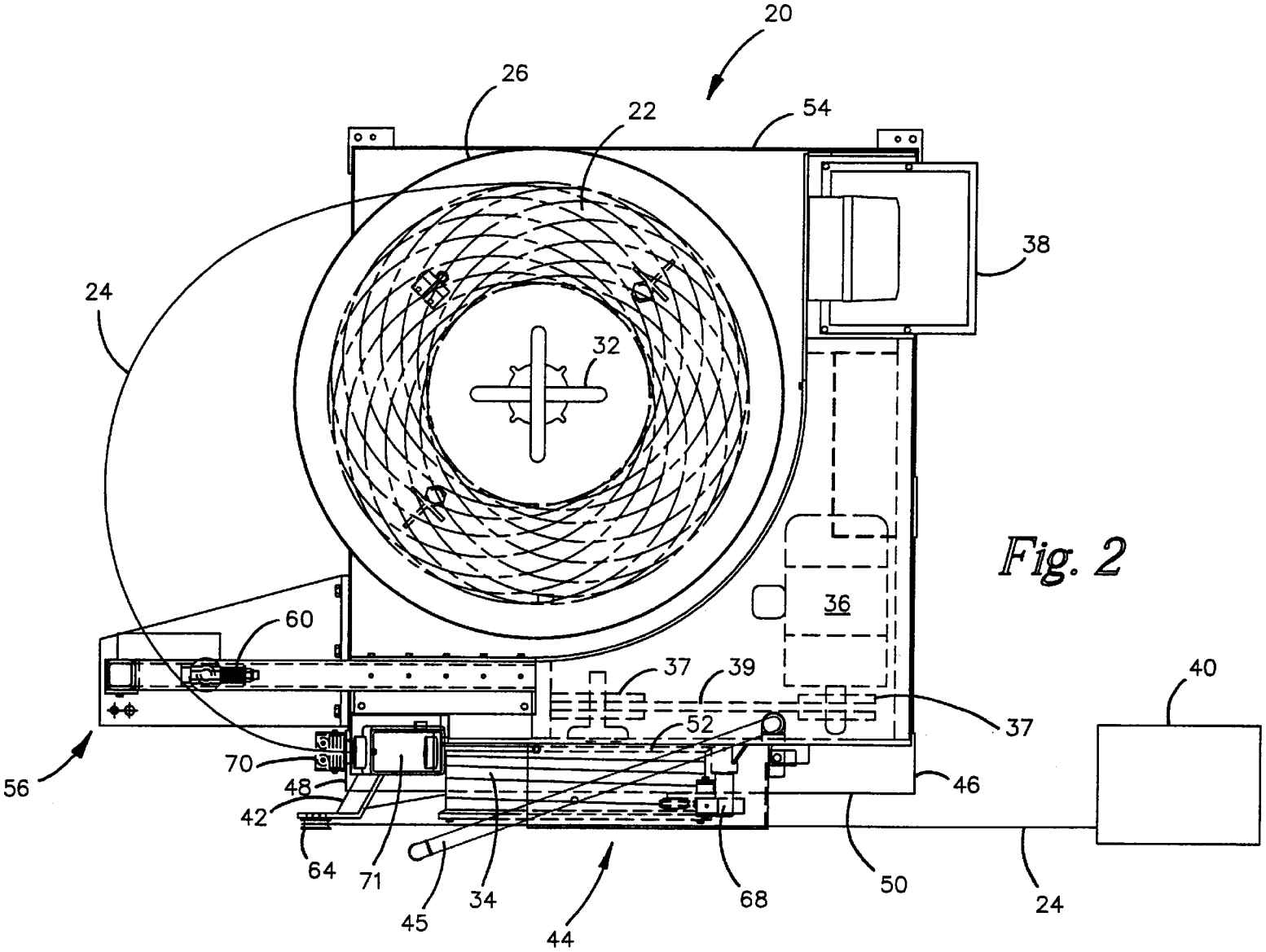
FIG. 2 is a top view of the embodiment shown in FIG. 1.

Referring now to the drawings, and with particular reference to FIG. 1, the preferred embodiment of the present invention is shown as wire drawing machine 20. As shown therein, machine 20 is adapted to hold wire coil 22, which itself is wound in a circular, spiral pattern. In accordance with the present invention, it can be seen that wire 24 is able to be unwound from coil 22 to follow the natural curvature or cast of wire coil 22. (See FIG. 2). In the preferred embodiment, machine 20 is adapted to accommodate wire 24 having a diameter of ⅜ inch and 9/16 inch, but in alternative embodiments, larger or smaller diameter wires can be drawn by the present invention.

Figure 3:
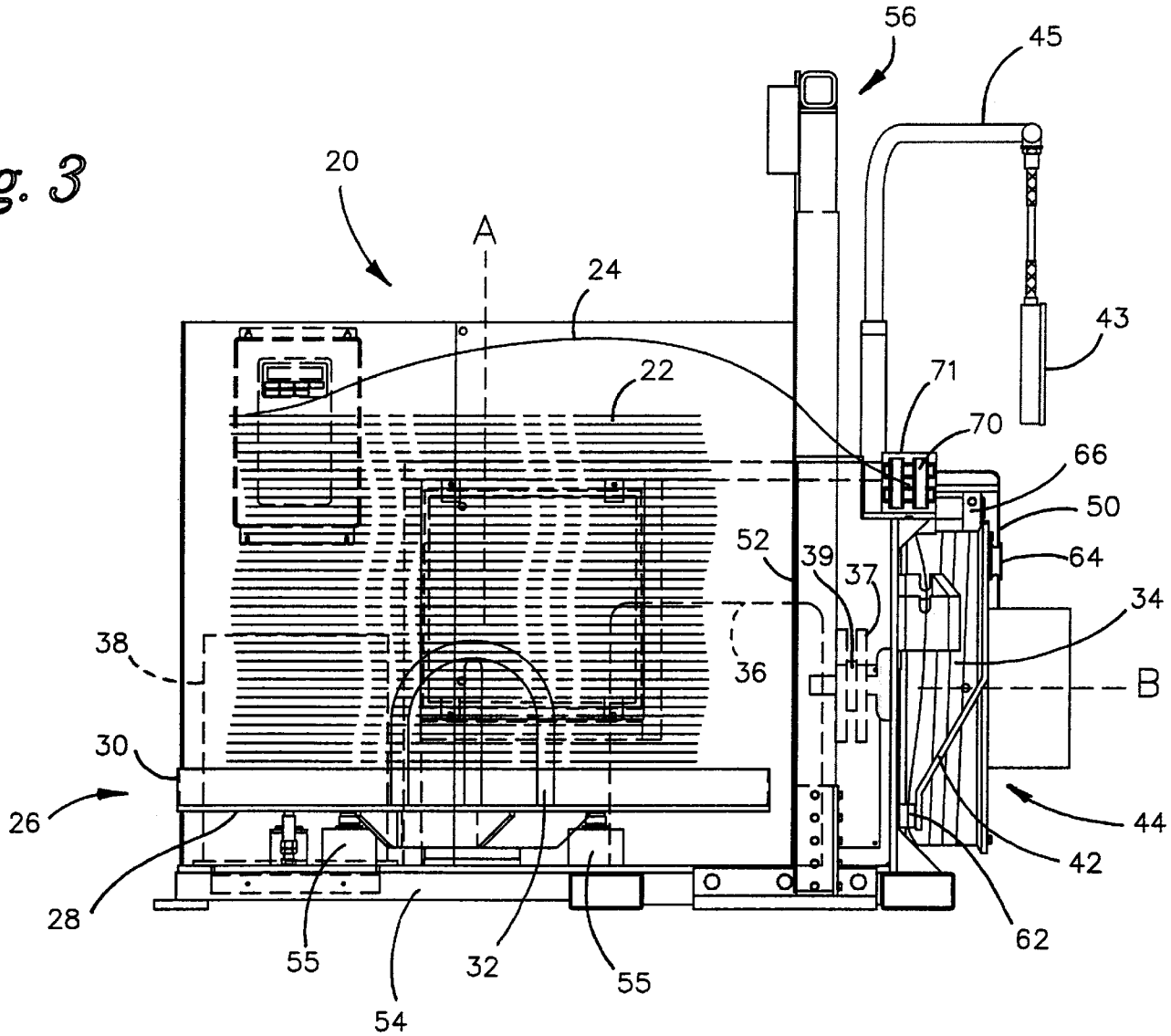
FIG. 3 is an end view of the embodiment shown in FIG. 1.
Figure 4:
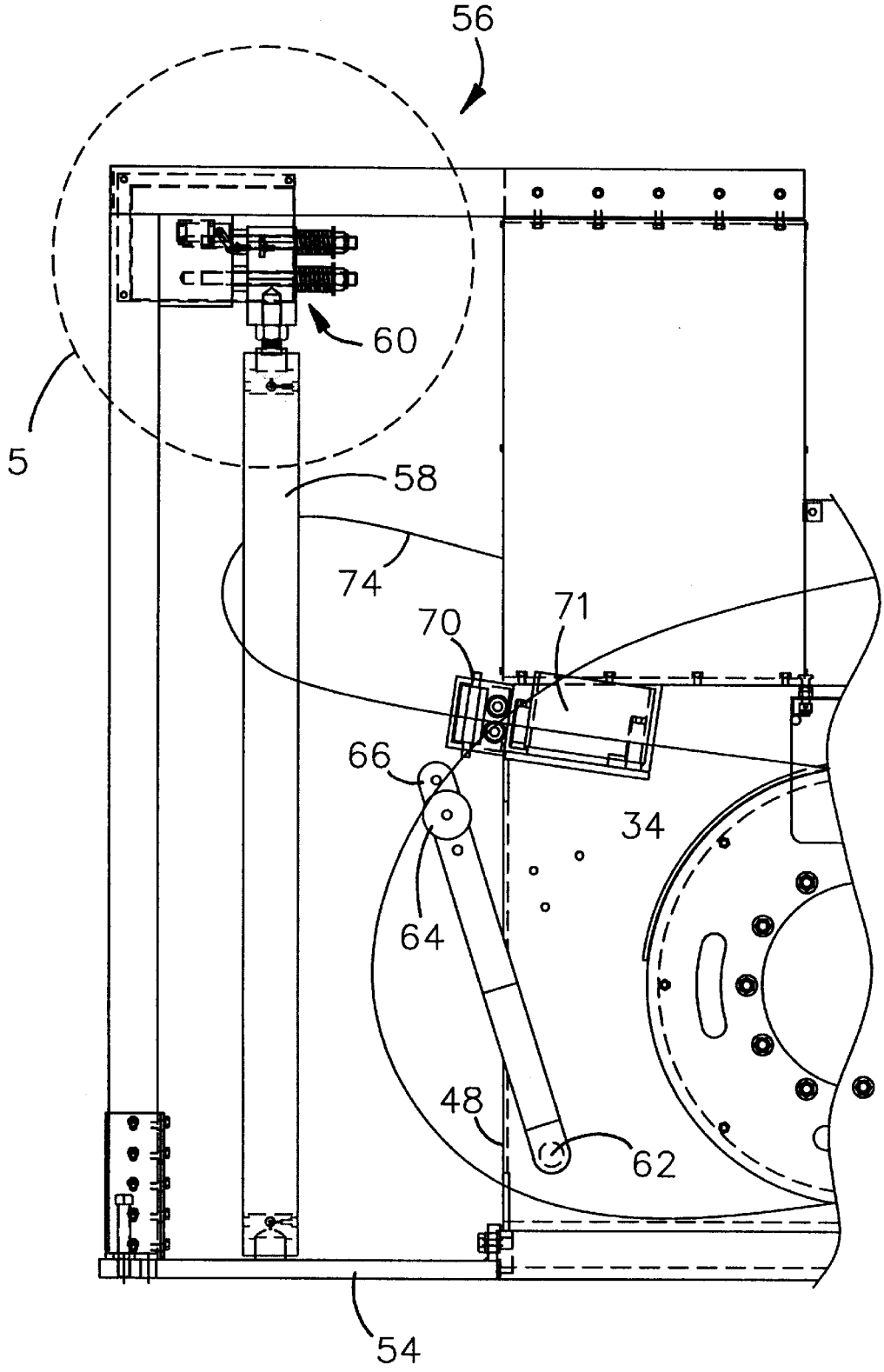
FIG. 4 is an enlarged side view of the snag detector system of the preferred embodiment.
Figure 5:
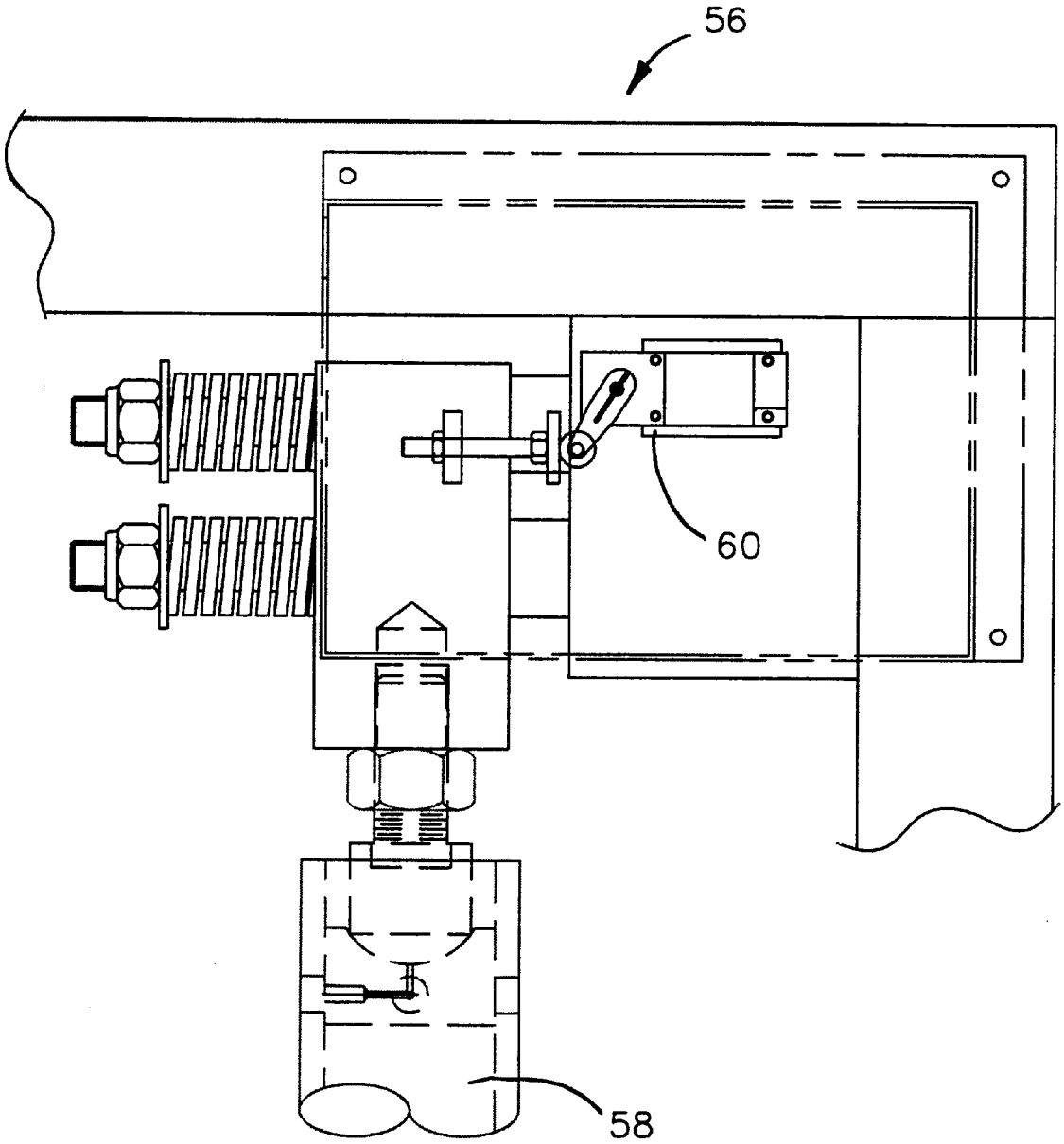
FIG. 5 is an enlarged side view of the limit switch depicted in area 5 of FIG. 4.

Wire coil 22 is provided on free wheeling turntable 26. As best shown in FIG. 3, turntable 26 is actually provided in basket-like structure in that a planar surface 28 is provided with upwardly extending side wall 30. A pair of inverted U-shaped rods 32 extend upwardly from the center of planar surface 28 to define a mandrel for coil 22. It is important to note that turntable 26 rotates about a vertically disposed axis A.

Turntable 26 is not power-driven, but rather rotates as result of the rotation of capstan 34. Capstan 34, in the preferred embodiment, is a cylindrical drum powered by an electric motor 36 which is connected to capstan 34 by pulleys 37 and belt 39. In the preferred embodiment, motor 36 is a variable speed motor in electronic communication with controller 38 to coordinate the speed of rotation of capstan 34 with the speed of end-use machine 40. This feature of the present invention will be discussed with further detail herein along with a description of compensation arm 42. Capstan 34, in the preferred embodiment, rotates about a horizontally disposed axis B.

As is conventional, wire 24 is trained around capstan 34 a number of times to provide a slip-grip thereto. Upon rotation of capstan 34, wire 24 is pulled from coil 22, which in turn causes turntable 26 to rotate to facilitate such pay out. An operator interface module 43 is provided on boom 45 to control operation of in-line wire drawing machine 20.

In accordance with the objectives and features of the present invention, it can be seen that turntable 26, and wire coil 22 are provided laterally adjacent to vertical support 44. Vertical support 44 includes front 46, back 48, first side wall 50, and second side wall 52. Capstan 34 is mounted to first side wall 50 while turntable 26 is provided adjacent to second side wall 52. It can also be noted from FIGS. 1–3 that turntable 26 and vertical support 44 are mounted to base 54 to allow the entire wire drawing machine 20 to be provided in integral form.

Figure 7:
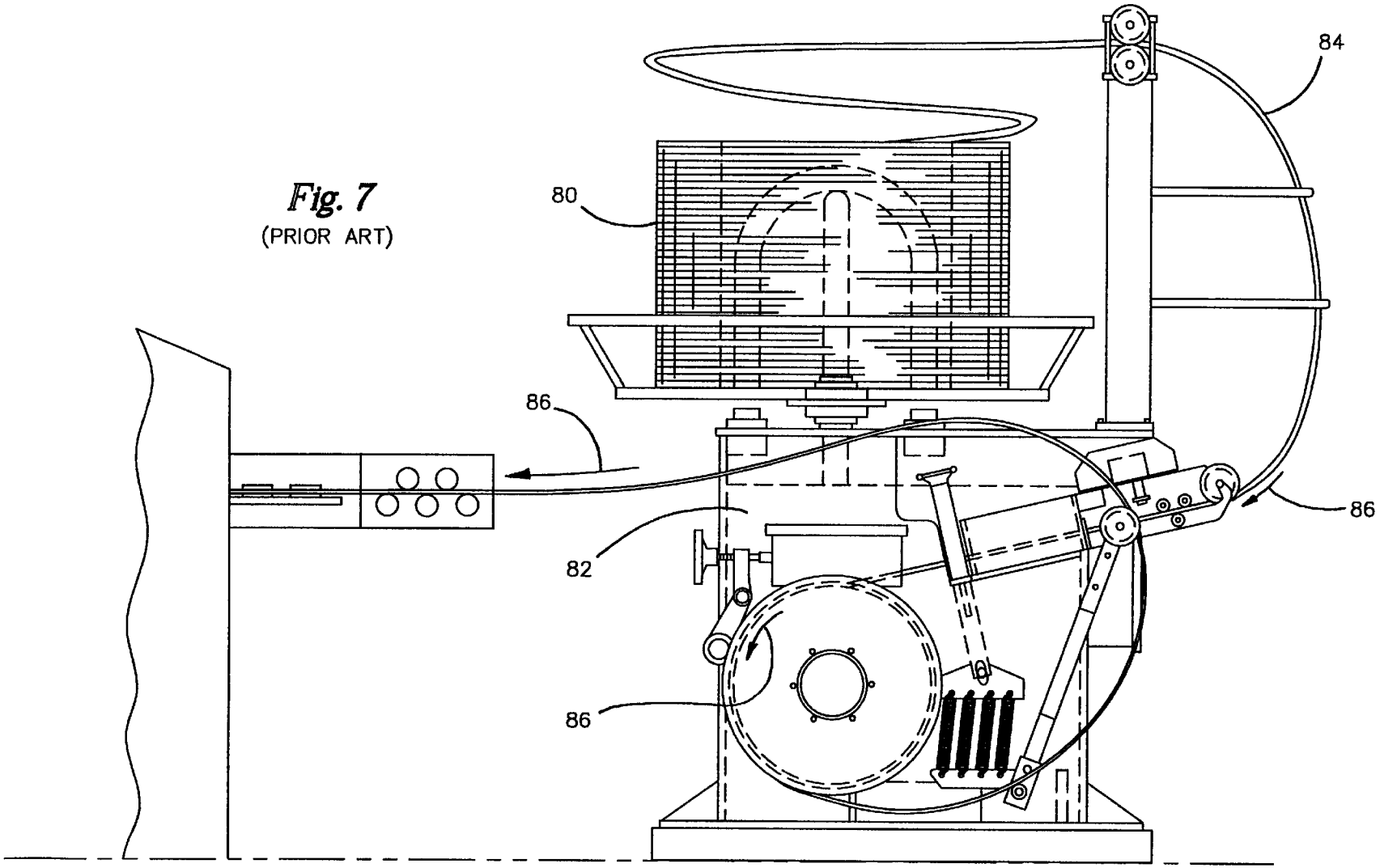
Fig. 7 (PRIOR ART)
FIG. 7 is a side view of a prior art, in-line wire drawing machine, with an overhead turntable.

Base 54 is provided with a relatively low height to allow turntable 26 to be mounted also at a relatively low height to facilitate placement of wire coils 22 on to turntable 26. Not only does this assist in the loading of coil 22 on to machine 20, but also eliminates the need, prevalent with prior art designs which place coil 22 at an elevated height, for a structurally reinforced vertical support for the heavy coil 22. (See FIG. 7). Base 54 also includes a pair of air cylinders 55 to stop rotation of the base when motor 36 is de-energized. The rods of cylinders 55 extend upwardly and frictionally engage planar surface 28 of turntable 26 to brake the turntable to a stop and prevent uncontrolled unwinding of coil 22 after capstan 34 stops rotating.

Another benefit of providing coil 22 at a lower height is that it enables wire 24 to be paid out in a natural flow following the curvature or the natural cast of wire coil 22. As used herein, the term "natural cast" is defined as the curvature or tendency of the wire 22 to curve due to its fabrication into a spiral coil. By allowing the wire 24 to be paid out from coil 22 along the natural cast of the coil, wire 24 can be easily threaded through the machine and not be forced against the natural cast of the wire 24. This in turn substantially eliminates the need for operator intervention in the form of contorting or forcing the wire against its natural cast to feed or guide the wire through the machine. Since the wire coil is often in excess of one-half inch in diameter, this represents a major advance in ease of operation. Turntable 26 is provided below capstan 34, in the preferred embodiment, to also facilitate the natural pay out.

In order to prevent snags in the wire coil from damaging the machine or slowing production, a snag prevention means is provided. In the preferred embodiment of the present invention, snag detection means 56 is provided in the form of vertical bar 58 which is mounted for lateral movement toward vertical support 44. Any lateral movement of vertical bar 58 is detected by limit switch 60 which, upon detection of lateral movement, sends a signal to controller 38 to stop rotation of motor 36 and thus rotation of capstan 34. Once the snag is identified and corrected, machine 20 can resume operation.

Compensation arm 42 is used to ensure capstan 34 rotates at an appropriate speed to correspond to the speed at which end-use machine 40 takes up wire 22. For example, if capstan 34 rotates faster than end-use machine 40 and thus pays out more wire than end-use machine 40 can take up, excess wire 22 will accumulate and detrimentally affect operation. Conversely, if capstan rotates slower than end-use machine, the machine will be slowed or damaged. Compensation arm 42 is therefore used as a mechanism by which the speed at which wire 22 is paid out can be measured.

In the preferred embodiment, compensation arm 42 is pneumatically loaded backward, meaning away from capstan 34. Since wire 22 is trained around roller 64, compensation arm 42 will pivot rearwardly, pushing wire 22 rearwardly as well. A position sensor monitoring the location of compensation arm 42 will then send a signal to controller 38. Depending on the measured position of compensation arm 42, controller 38 will direct capstan motor 36 to slow or increase speed to thus slow or increase the rate at which wire 22 is paid out. In alternative embodiments, compensation arm 42 can be spring or otherwise loaded, as opposed to pneumatically loaded.

Rollers 68 are provided to ensure wire 22 stays on capstan 34 when rotation stops. It can be seen from FIG. 1 that rollers 68 are movable from the retracted position shown in solid lines to the active position shown in dashed lines wherein rollers 68 exert force against wire 22 and capstan 34 to maintain the position of wire 22 when rotation stops.

Another feature of the present invention to provide for an orderly pay out of wire 24 is bi-planar roller set 70. Roller set 70 is bi-planar in that a first set of rollers are disposed horizontal to base 54, while a second set of rollers downstream from the first set of rollers is disposed vertical to the base 54. Roller set 70 serves to direct wire 24 before passing through drawbox 71 to reduce the diameter of wire 24.

Figure 6:
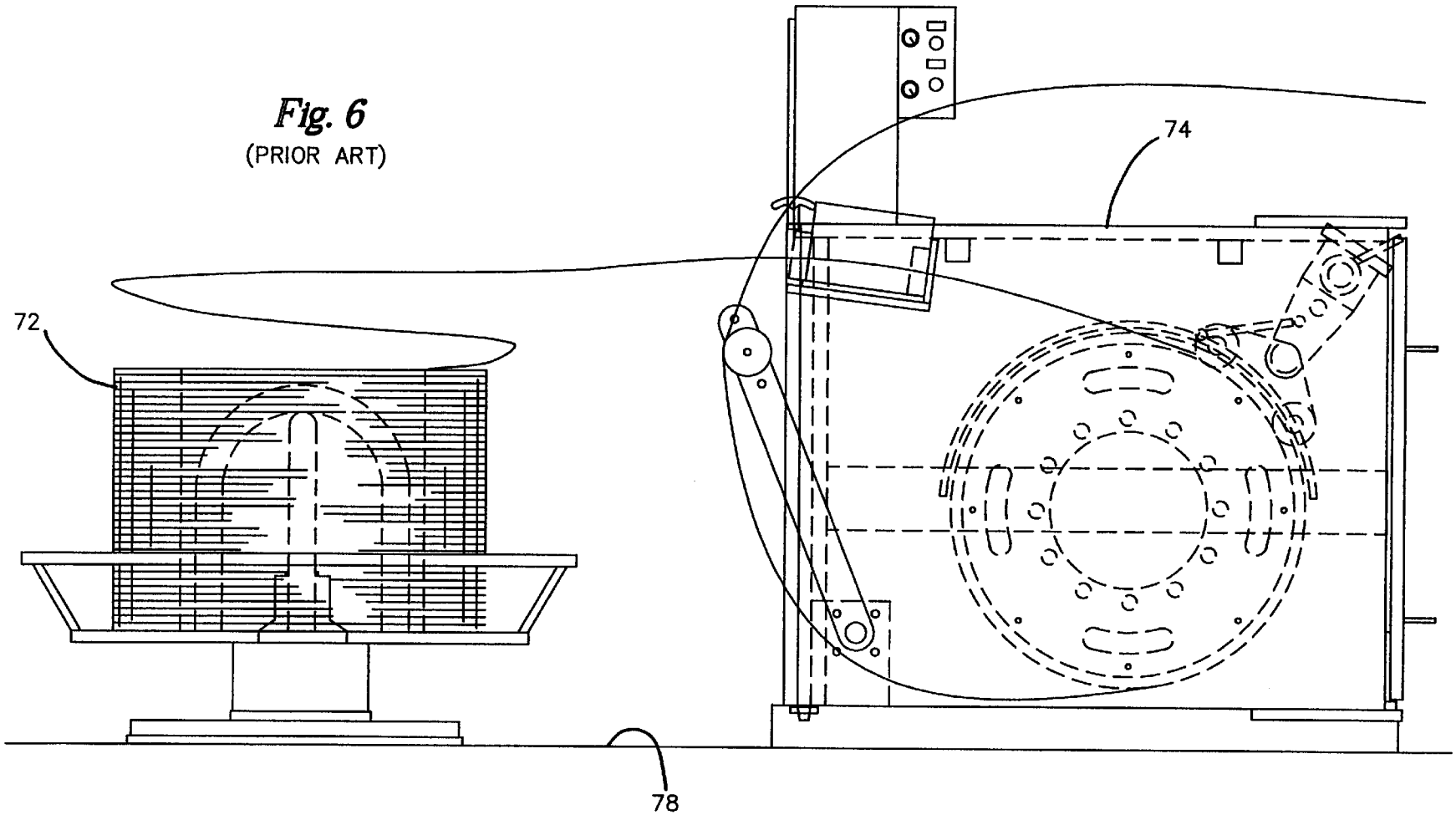
Fig. 6 (PRIOR ART)
FIG. 6 is a side view of a prior art, linearly disposed, in-line drawing machine.

From the foregoing, it can therefore be appreciated by one of ordinary skill in the art, that the present invention provides a wire drawing machine which occupies much less space than conventional linearly disposed inline drawing machines (See FIG. 6). As shown in FIG. 6, coil 72 is provided at one end, while prior art wire drawing machine 74 is provided at the other end, linearly downstream of coil 72. As a result, a relative long expanse of floor 78 is occupied.

Moreover, not only does the present invention minimize the actual footprint of the machine, but also enables the wire coil to be disposed at lower level to facilitate loading of new coils on to the machine, and facilitates a natural pay out. (See FIG. 7). As shown in the prior art therein, coil 80 is supported on base 82, with wire 84 being required to traverse a complex path against its natural cast as indicated by arrows 86.

By providing the capstan at the same horizontal level as the wire coil and disposing the capstan on a side adjacent to the wire coil, the coil is able to be paid out along an arc following the natural arcuate cast of the wire coil. This enables the operator of the machine to easily thread the wire through the capstan and the various rollers of the machine without numerous bends and turns which can sometimes be an arduous task, especially with larger diameter wire coils. The present invention therefore provides a space saving, economical and efficient in-line wire drawing machine.

What is claimed is:

1. An in-line wire drawing machine for unwinding wire from a coil of wire and feeding the wire to a downstream end-use machine, the coil of wire being cast in a spiral pattern and thus having an arcuate natural cast, the in-line wire drawing machine, comprising:

a base provided at shop floor level;

a vertical support extending upwardly from the base and substantially above the shop floor level, the support including a front, a back, and first and second opposed sides;

a turntable rotatably mounted to the base and disposed adjacent and below the first side of the support, the coil of wire being mounted on the turntable; and a power-driven capstan mounted on the second side of the support, the wire extending from the coil, around the back of the support and being trained around the capstan such that rotation of the capstan pulls the wire from the coil along an arc following the natural arcuate cast of the wire coil.

2. The in-line wire drawing machine of claim 1, further including means for detecting a snag in the wire coil and for automatically stopping rotation of the capstan when a snag is detected.

3. The in-line wire drawing machine of claim 2, wherein the means for detecting a snag includes a vertical bar mounted behind the back of vertical support, the vertical bar mounted for lateral movement toward the back of the vertical support, and a limit switch adjacent to the vertical bar to detect the lateral movement, a snag in the wire causing the wire to pull against the vertical bar, laterally move the vertical bar, activate the limit switch and stop rotation of the capstan.

4. The in-line wire drawing machine of claim 1, wherein the rotational axis of the turntable is vertically aligned and the rotational axis of the capstan is horizontally aligned.

5. The in-line wire drawing machine of claim 1, further including a means for guiding the wire from the coil to the capstan.

6. The in-line wire drawing machine of claim 5, wherein the means for guiding includes a set of bi-planar rollers mounted on the second side of the vertical support, the wire being guided through the guide means as the wire is paid off the coil.

7. The in-line wire drawing machine of claim 6, further including a drawbox means disposed alone the natural arcuate cast of the wire for reducing the diameter of the wire.

8. The in-line wire drawing machine of claim 1, wherein the turntable is able to freely rotate and caused to rotate by the power-driven capstan.

9. The in-line wire drawing machine of claim 1, further including a compensation arm pivotally mounted to the vertical support behind the capstan, the compensation arm including a roller about which the wire is trained after being paid out from the capstan, the compensation arm adapted to pivot, the drawing machine further including a controller to monitor the position of the compensation arm and adjust the speed of the capstan depending on the position of the compensation arm.

10. The in-line wire drawing machine of claim 1, wherein the wire coil has a diameter ranging from ⅜" to 9/16".

11. An in-line wire drawing machine, for placement on a shop floor to unwind wire from a coil of wire and feed the wire to an end-use machine, the intended wire coil having wire coiled in one direction in a natural arcuate cast the in-line wire drawing machine comprising:

turntable means adapted to hold a coil of wire to be unwound, the turntable means being rotatable about a vertically disposed axis;

capstan means adapted to have the wire wound there-around and pulled from the coil, the capstan means being rotatable about a horizontally disposed axis;

the turntable means and capstan means being disposed at substantially the same distance to the shop floor and being disposed at substantially the same distance from the end-use machine; and a predetermined wire path between the turntable means and capstan means, the predetermined wire path substantially coinciding with the natural arcuate cast of wire without any bending directly against the natural arcuate cast.

12. The in-line wire drawing machine of claim 11, further including means for detecting a snag in the wire coil and for automatically stopping rotation of the capstan means when a snag is detected.

13. The in-line wire drawing machine of claim 12, wherein the means for detecting a snag includes a vertical bar mounted behind the capstan means, the vertical bar mounted for lateral movement toward the capstan means, and a limit switch adjacent the vertical bar to detect the lateral movement, a snag in the wire causing the wire to pull against the vertical bar, laterally move the vertical bar, activate the limit switch and stop rotation of the capstan means.

14. The in-line wire drawing of claim 11, further including a means for guiding the wire from the turntable means to the capstan means.

15. The in-line wire drawing machine of claim 14, wherein the means for guiding includes a set of bi-planar rollers mounted on the second side of the vertical support, the wire being guided through guide means as the wire is paid off the coil.

16. The in-line wire drawing machine of claim 15, further including a drawbox means disposed along the natural arcuate cast for reducing the diameter of the wire.

17. The in-line wire drawing machine of claim 11, wherein the turntable means is able to freely rotate and caused to rotate by the power-driven capstan.

18. The in-line wire drawing machine of claim 17, further including a compensation arm pivotally mounted to the vertical support behind the capstan, the compensation arm including a roller about which the wire is trained after being paid out from the capstan, the compensation arm adapted to pivot, the drawing machine further including a controller to monitor the position of the compensation arm and adjust the speed of the capstan depending on the position of the compensation arm.

19. The in-line wire drawing machine of claim 11, wherein the in-line wire drawing machine can process wire coil having a diameter ranging from ⅜" to 9⁄16".

20. In an in-line wire drawing machine of the type having a rotatable turntable supporting a wire coil to be unwound and a power-driven capstan around which the wire is trained such that rotation of the capstan rotates the turntable and unwinds the wire, the intended wire coil having wire coiled in one direction in a natural arcuate cast, the improvement comprising:

a base for mounting the turntable at floor level to facilitate loading of the wire coil on to the turntable, the base defining a horizontal plane and the turntable rotating about a vertical axis orthogonal to the horizontal plane;

a vertical support extending from the base for mounting the power-driven capstan, the vertical support defining a vertical plane and the capstan rotating about a horizontal axis orthogonal to the vertical plane and parallel to the horizontal plane, the turntable being disposed below the horizontal axis defined by the power-driven capstan; and a predetermined wire path between the capstan and the turntable extending horizontally around the vertical support and substantially coinciding with the natural arcuate cast of the intended wire coil without bending directly against the natural arcuate cast of the wire.

* * * * *